United States Patent [19]

Gerke et al.

[11] Patent Number: 4,611,874

[45] Date of Patent: Sep. 16, 1986

[54] DEVICE FOR MAKING LSA-PLUS CONTACT WITH CONDUCTOR WIRES OF DIFFERENT TYPES AND SIZES

[75] Inventors: Dieter Gerke; Horst Forberg; Wolfgang Radelow, all of Berlin, Fed. Rep. of Germany

[73] Assignee: Krone GmbH, Berlin, Fed. Rep. of Germany

[21] Appl. No.: 715,582

[22] Filed: Mar. 25, 1985

Related U.S. Application Data

[63] Continuation of Ser. No. 449,457, Dec. 13, 1982, abandoned.

[30] Foreign Application Priority Data

Feb. 27, 1982 [DE] Fed. Rep. of Germany ..... 3207186

[51] Int. Cl.[4] ..... H01R 4/02

[52] U.S. Cl. ..... 339/97 R; 339/256 R

[58] Field of Search ..... 339/97 R, 97 P, 98, 339/99 R, 220, 221, 256 R

[56] References Cited

U.S. PATENT DOCUMENTS

| | | | |
|---|---|---|---|
| 2,270,337 | 1/1942 | Rensak | 339/221 M |
| 3,162,501 | 12/1964 | Wahl | 339/98 |
| 3,168,615 | 2/1965 | Owen et al. | 339/98 |
| 3,248,687 | 4/1966 | Immel | 339/221 M |
| 3,854,114 | 12/1974 | Kloth et al. | 339/97 R |
| 3,867,005 | 2/1975 | Hoppe | 339/98 |
| 3,910,671 | 10/1975 | Townsend | 339/97 R |
| 3,910,672 | 10/1975 | Frantz | 339/97 P |
| 3,993,393 | 11/1976 | Worth | 339/99 R |
| 4,118,103 | 10/1978 | Leidy et al. | 339/98 |

*Primary Examiner*—Gil Weidenfeld
*Assistant Examiner*—David L. Pirlot
*Attorney, Agent, or Firm*—Baker, Maxham & Jester

[57] ABSTRACT

The subject matter of the invention relates to a device having a unitary terminal element (1) of X-shaped cross-section, in which the conductor wire (2), especially aluminum or multi-wire copper conductors, is adapted to be inserted centrally into the slot (10) through two insertion openings (3, 4) each of which includes a V-shaped centering portions (6) and two offset cutting lances (7, 8) at the lower end thereof, said cutting lances being intended to rip open the conductor insulation at offset and opposite locations. The size of the conductor wire (2) to be terminated, the slot width, and the resilient slot walls (10*a*, 10*b*) determine the contact pressure. The air gap of the slot (10) has an automatic matching function (e.g. when the conductor material ages) and ensures a continually sufficient contact pressure.

12 Claims, 5 Drawing Figures

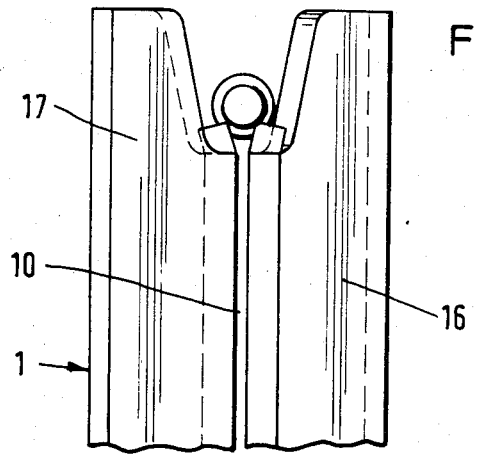
Fig. 4
Fig. 5
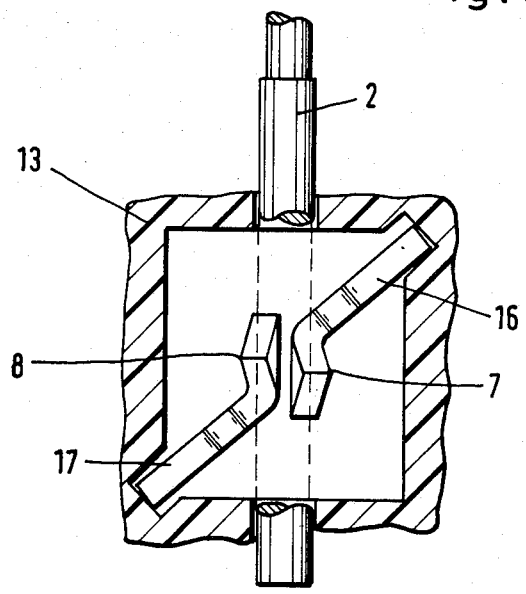

DEVICE FOR MAKING LSA-PLUS CONTACT WITH CONDUCTOR WIRES OF DIFFERENT TYPES AND SIZES

This is a continuation of co-pending application Ser. No. 449,457 filed on Dec. 13, 1982, now abandoned.

The invention relates to a contact-making device (briefly: LSA-PLUS-contact (translator's note: LSA-PLUS originates from the German words löt-, schraub- und abisolierfreier Kontakt mit polytropem Luft-Spaltu)) having a polytropic air gap for the solderless, non-screwed and non-stripped termination of an insulated conductor, especially of an aluminium or a multi-wire copper conductor, in the slot of a fixedly mounted terminal element.

The applicant has developed a termination technique for the solderless, non-screwed and non-stripped termination of conductor wires to terminals, which in the meantime has become widely accepted under the name LSA-PLUS termination technique.

In this LSA-PLUS termination technique, upright terminal elements secured in a terminal strip and made of thin spring plate are employed, in which an open elongated slot is defined between two lateral spring arms, the width of said slot being slightly smaller than the size of the conductor wire.

The spring arms are offset relative to each other by means of deformation such that, when the conductor wire is inserted, the relatively sharp edges of the spring arms, which define the contact slot, initially sever the insulation and subsequently penetrate into the conductor material by a predetermined amount, thereby effecting electrically conductive contact.

During this operation electrical connections are made which are extremely durable and permanently protected from corrosion, while it is not necessary first to strip either the cable or the conductor wire or to provide threaded connections or, respectively, soldered connections.

It is a drawback of a terminal element of the kind specified above and described in the DE-PS No. 2,610,461, that it is not every conductor wire that can readily be terminated.

For instance, aluminium wires or multi-wire copper conductors (stranded wire) cannot readily be terminated by means of this terminal element.

It is therefore the object of the present invention to provide by the application of the LSA-PLUS-technique a contact device for conductor wires, especially also for aluminium and multi-wire copper conductors, which guarantees perfect contact and is capable of accommodating different wire sizes, and which may be inserted into the so far used LSA-terminal strips and in which also the tools so far used for inserting and, respectively, withdrawing the conductor wire may be employed advantageously.

The solution of this object is based on the design of a terminal element having a contact slot the air gap of which is designed for automatic adaptation (e.g. when the conductor material ages) and which always ensures sufficient contact pressure.

The subject matter of the present invention, by which the specified object is solved, is a device for making a solderless, non-screwed and non-stripped contact having a polytropic air gap between a terminal element of leaf-shaped resilient contact material and a conductor to be terminated in the slot thereof, said device being characterized in that the unitary terminal element is of X-shaped cross-section and the conductor wire, especially aluminium conductors or multi-wire copper conductors, is adapted to be inserted centrally into the slot via two insertion openings each of which includes a substantially V-shaped centering portion and a offset cutting lance at the lower end thereof, which cutting lances are intended to rip open the conductor insulation at offset and opposite locations, wherein the size of the conductor wire to be terminated, the width of the slot, and the resilient slot walls determine the contact pressure.

By means of this device it is possible to perfectly terminate conductor wires of different sizes, even if aluminium or multi-wire copper wires are concerned.

Preferably, a wedge-like space is formed between the cutting lances.

Further embodiments of the device provide that the width of the slot may be adapted to the wire size of the conductor wire, that the size of the area of contact between slot walls and conductor wire may be selected as desired, that the terminal element is composed either of two parts having V-shaped cross-section and being fixedly joined to each other by a connecting member, or is alternatively composed of two hook-like parts.

Embodiments of the invention will be described in detail with reference to the accompanying drawing, in which:

FIG. 4 is a further embodiment of the terminal element including two hook-shaped parts; and FIG. 5 is a plan view of the embodiment of FIG. 4.

Figure 1:
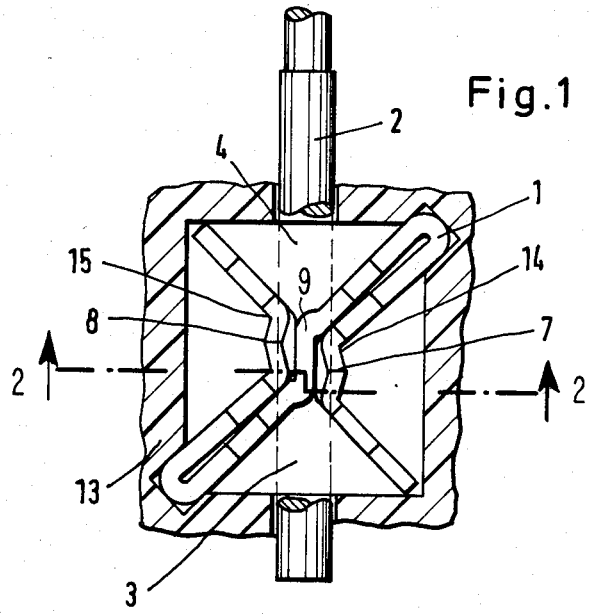
FIG. 1 is a plan view, partially in section, of the X-shaped terminal element in accordance with an embodiment of the invention.

It is apparent from FIG. 1 that the unitary terminal element 1 for the connection of conductors 2, especially of aluminium conductors and multi-wire copper conductors, is of X-shaped cross-section.

This design advantageously permits a high stability with thin material. Due to the X-shaped two V-shaped insertion openings 3, 4 are formed above the slot 10.

Figure 2:
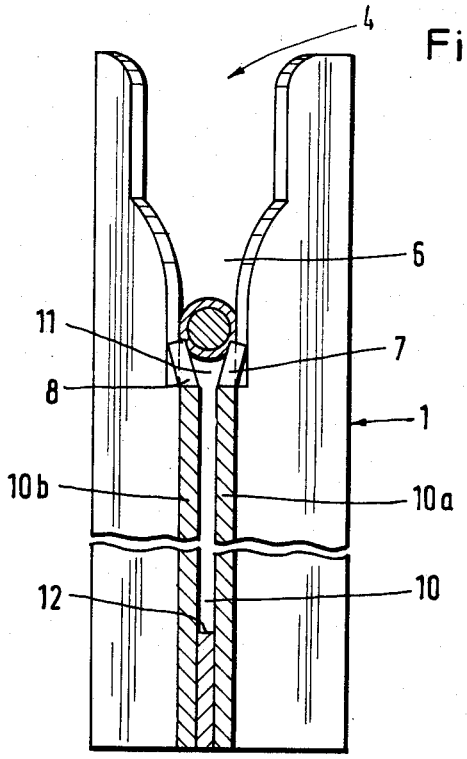
FIG. 2 is a sectional view 2—2 of FIG. 1.

FIG. 2 shows the rear insertion opening 4. Like the insertion opening 3, the insertion opening 4 is provided with a substantially V-shaped centering portion 6, which guides the conductor 2 centrally towards two cutting lances 7, 8 which are integrally formed with the lower end of the centering portion 6.

As is clearly apparent from FIG. 1, the cutting lances 7, 8 are offset relative to each other, so that the conductor insulation will be ripped open in an offset manner before the conductor 2 reaches the slot 10.

Figure 3:
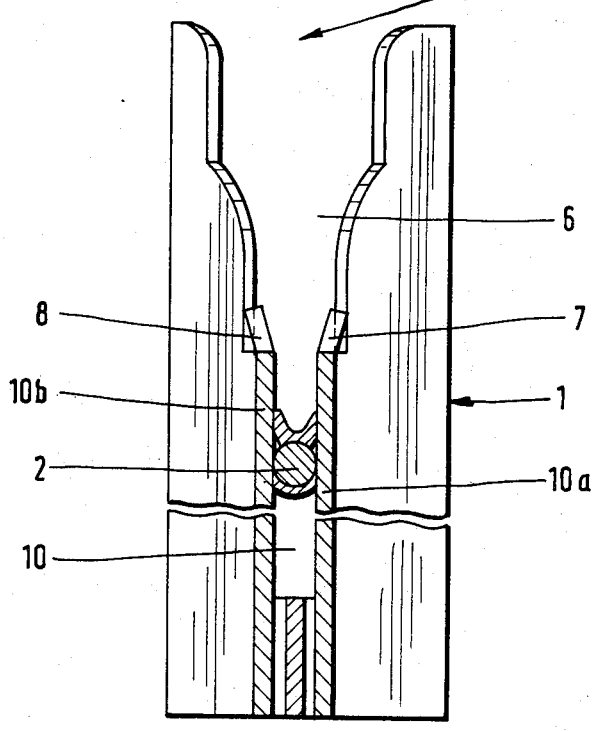
FIG. 3 is the sectional view 2—2 of FIG. 1 showing a conductor in the contact-making position.

Furthermore, the two cutting lances 7, 8 define a wedge-like space 11 relative to one another, which facilitates the cutting operation. FIG. 3 shows the conductor 2 after insertion into the slot; here, the slot walls 10*a*, 10*b* are resiliently urged against the conductor core.

In addition to the conductor size, the slot width and the resilient slot walls 10*a*, 10*b* determine the contact pressure; if larger conductor sizes are used, the contact pressure will be increased accordingly.

FIG. 3 also shows how the insulation of the conductor 2 is displaced after the cutting operation and how the slot walls 10*a*, 10*b* spring back. After surface contact has been made, the slot width corresponds to the conductor size.

The area of contact may be enlarged as desired by means of wider cutting lances 7, 8.

The insertion operation of the conductor 2 may be terminated, for instance, by the abutment 12, which in the present case is formed by a transverse portion of the terminal element 1.

Alternatively, the terminal element 1 may be formed of two V-section members 14, 15, which are fixedly joined to each other by means of a connecting member 9.

A further embodiment of the invention is shown in FIGS. 4 and 5.

The terminal element 1 is formed of two hook-like parts 16, 17. In this case, too, the width of the cutting lances 7, 8 determines the size of the area of contact.

In either embodiment the terminal element 1 is adapted to be inserted into the conventional LSA-PLUS terminal strip 13 indicated in FIGS. 1 and 5. The known insertion and withdrawing tools of the LSA-system may also be employed.

We claim:

1. A terminal for terminating an elongated electrical conductor having insulation therearound, said terminal being formed of leaf-shaped resilient contact material having a slot forming a polytropic air gap for making solderless, non-screwed and non-stripped contact with the conductor, said terminal comprising:

first and second members, each having:

a body portion with an inner longitudinal slot wall;

a single cutting lance at the top of said slot wall; and a centering edge sloping generally upward from said cutting lance to the top of said body portion;

said first and second member being arranged to form said slot as a top opening gap between said slot walls and being resiliently joined below said slot, said cutting lances being in offset confronting relationship, said centering edges forming a V-shaped centering portion for guiding the conductor onto said cutting lances and into said slot between said slot walls, said slot being oriented perpendicularly with respect to the axis of the conductor, said cutting lances attached to said slot walls defining an axis perpendicular to the insertion axis of the conductor;

whereby upon insertion of the conductor into said centering portion, said cutting lances rip open the conductor insulation at offset locations along the conductor axis and defining a wedge-like space relative to each other facilitating the insulation cutting operation, said slot walls flex laterally, perpendicular to the insertion axis of the conductor to accommodate the conductor in said slot, said slot walls gripping said conductor at a location remote from said cutting lances at a bottom portion of said slot, wherein the size of the conductor, the width of said slot and the resilience of said slot walls determine the contact pressure of said terminal on the conductor.

2. The terminal recited in claim 1 wherein said terminal is adapted to terminate conductors of different sizes.

3. The terminal recited in claim 1 wherein said cutting lances define a wedge-like space relative to one another.

4. The terminal recited in claim 1 wherein the width of said slot may be adapted to the size of the conductor.

5. The terminal recited in claim 1 wherein the size of the area of contact of said slot walls with the conductor may be selected as desired.

6. The terminal recited in claim 1 wherein said first and second members each formed with a hook-like configuration in cross section.

7. The terminal recited in claim 1 wherein said first and second members are formed of two V-shaped cross sectional members which are joined to each other by means of a connecting member.

8. The terminal recited in claim 7 wherein said terminal is a unitary member of X-shaped cross section defining insertion openings on either side in line with said slot.

9. A terminal for terminating elongated electrical conductors having insulation therearound, said terminal being formed of leaf-shaped resilient contact material having a slot forming a polytropic air gap for making solderless, non-screwed and non-stripped contact with the conductor, said terminal comprising:

a unitary member of X-shaped cross section forming insertion openings on either side of said slot;

said X-shaped unitary member being formed with V-shaped centering portions for guiding the conductor toward said slot;

said X-shaped unitary member having a single cutting lance at the bottom of each centering portion, said cutting lances being adpated to rip open the conductor insulation at offset locations long the conductor axis and defining a wedge-like space relative to each other facilitating the insulation cutting operation;

said X-shaped unitary member forming said slot between confronting slot walls located below said cutting lances, said slot walls being resiliently joined below said slot, said slot being formed as a top opening gap between said slot walls and being adapted to resiliently receive the conductor therebetween and make electrical contact therewith, said slot being oriented perpendicularly with respect to the axis of the conductor, said cutting lances attached to said slot walls defining an axis perpendicular to the insertion axis of the conductor, said slot walls gripping said conductor at a location remote from said cutting lances at a bottom portion of said slot;

wherein the size of the conductor to be terminated, the width of said slot and the resilience of said slot walls determine the contact pressure.

10. The terminal recited in claim 9 wherein said cutting lances define a wedge-like space relative to one another.

11. The terminal recited in claim 9 wherein the width of said slot may be adapted to the size of the conductor.

12. The terminal recited in claim 9 wherein the size of the area of contact of said slot walls with the conductor may be selected as desired.

* * * * *